US008161656B1

(12) United States Patent
Ellgass

(10) Patent No.: US 8,161,656 B1
(45) Date of Patent: Apr. 24, 2012

(54) ARCHERY SCOPE

(75) Inventor: Daniel E. Ellgass, Big Island, VA (US)

(73) Assignee: Gregory E. Summers, Madison Heights ( * ) Notice: Subject to any disclaimer, the term of this patent is extended or adjusted under 35 U.S.C. 154(b) by 0 days.

(21) Appl. No.: 12/964,254

(22) Filed: Dec. 9, 2010

(51) Int. Cl.
*F41G 1/467* (2006.01)

(52) U.S. Cl. ..... 33/265; 124/87

(58) Field of Classification Search ..... 33/265; 124/87
See application file for complete search history.

(56) References Cited

U.S. PATENT DOCUMENTS

| | | | | |
|---|---|---|---|---|
| 6,601,308 | B2 | 8/2003 | Khoshnood | |
| 7,331,112 | B2 * | 2/2008 | Gibbs | 33/265 |
| 2011/0271535 | A1 * | 11/2011 | Varner et al. | 33/265 |
| 2011/0277329 | A1 * | 11/2011 | Summers et al. | 33/265 |

* cited by examiner

*Primary Examiner* — G. Bradley Bennett
(74) *Attorney, Agent, or Firm* — Leading-Edge Law Group, PLC

(57) ABSTRACT

An archery scope includes a housing open at both ends and having a longitudinal axis. The housing has a tapered inner surface defining a narrow portion intermediate the ends of the housing. The tapered narrow portion provides a Ventrui-like effect where the interior of the housing appears substantially circular when viewed from various angles relative to the housing axis. A sight assembly is adjustably connected with the narrow portion of the housing inner surface and includes a ring having a diameter corresponding with an inner diameter of the housing and a sight portion coaxial with the ring and housing.

20 Claims, 8 Drawing Sheets

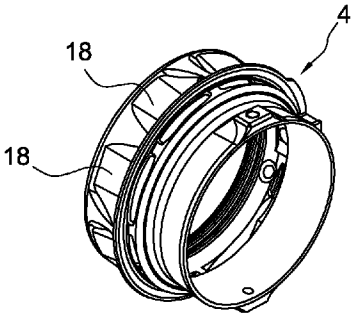
FIG. 3
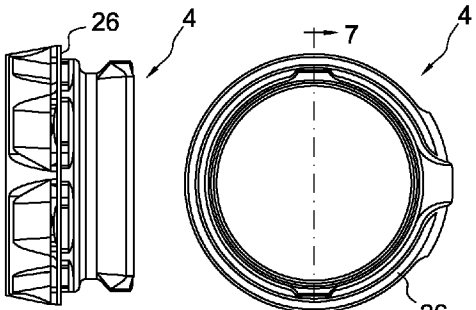
FIG. 4
FIG. 5
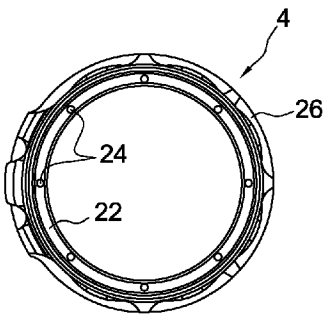
FIG. 6
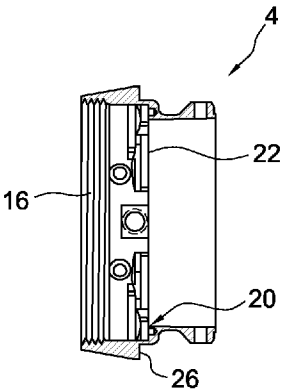
FIG. 7
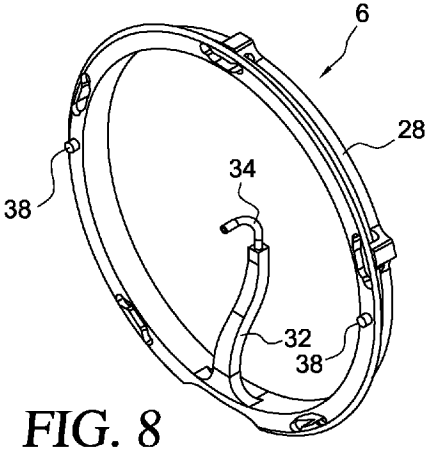
FIG. 8
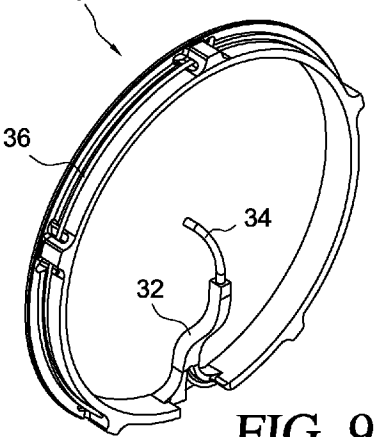
FIG. 9

ARCHERY SCOPE

BACKGROUND OF THE INVENTION

As archery grows in popularity, there is a greater demand for improved accuracy. This applies both to hunting and to tournament archery. There is a need for sighting devices which assist the archer in aligning the bow with the target. The present invention relates to an improved scope which is attached to a bow and which enables the archer to properly position the bow and focus on the target with greater precision than conventional scopes.

BRIEF DESCRIPTION OF THE PRIOR ART

Archery scopes and sights are well known in the prior art as evidence by the US patent to Khoshnood No. 6,601,308 which discloses a bow sight with an illuminated target pin or crosshair. A fiber optic filament is wound a number of times around the sight to collect ambient light and supply it via the filament to an end portion thereof which is attached to a pin or crosshair of the sight. The lit bow sight allows the hunter or archer to sight targets in low light environments.

The Summers et al U.S. patent application Ser. No. 12/332,410 discloses an archery sight with an improved scope and sight pin arrangement. The scope has an inner surface which tapers from the ends toward the middle of the scope to provide a Venturi-like effect to assist the user in sighting a target when viewed off-angle, i.e. when the user is not viewing the target and sight pin straight on through the sight. The sight pin includes a body component which is inserted through an opening in the scope and which receives an optical fiber which terminates at the end of the sight pin to provide a sight indicator for the user to align with the target.

While the prior devices operate satisfactorily, they are somewhat limited in that they can not be modified by the user to suit the user's personal preferences. The present invention was developed in order to overcome these and other drawbacks of the prior archery sights by providing an improved scope designed to fit the user's preferences and increase the accuracy of the archer.

SUMMARY OF THE INVENTION

Accordingly, it is a primary object of the invention to provide an archery scope including a generally cylindrical housing open at both ends and having a longitudinal axis. The housing has an inner surface which tapers from the ends toward to the middle to define narrowed portion intermediate the ends of the housing which provides a Venturi-like effect. A sight assembly is adjustably connected with the narrowed portion of the housing inner surface. The sight assembly includes a ring having a diameter corresponding with the inner diameter of the housing and a sight portion coaxial with the ring and the housing.

The housing contains an annular seat within the narrowed portion against which the ring of the sight assembly is arranged and an external annular flange generally coplanar with the portion of the narrowed portion of the housing which has the smallest diameter and with the sight portion. An annular retainer is threadably connected with the housing and presses the sight assembly ring against the seat when the retainer is connected with the housing. The seat contains a plurality of equally spaced openings for receiving pegs attached to the sight assembly ring. Thus, the angular orientation of the ring relative to the housing may be adjusted by selecting into which openings the pegs are inserted.

An annular indicator ring is provided between the sight assembly ring and the retainer. The indictor ring is only visible to the user when the bow is under excessive torque. Thus, the ring assists the user in determining when the bow is torqued at full draw, resulting in greater accuracy.

The housing is connected with a sight via a yoke. In this manner, the scope is more securely connected because the yoke includes two arm portions for connection with the housing at spaced locations. Such a connection eliminates vibrations between the scope and housing and prevents the scope from detaching from the housing over time.

According to a preferred embodiment of the invention, the sight assembly includes a sight pin connected with the ring and having an end defining the sight portion. The sight pin includes an optical fiber having one end at the sight portion and having a length coiled around the ring for receiving ambient light via openings in the housing which communicate with the narrowed portion of the housing inner wall.

A lens assembly may be provided for use with or without the sight pin. The lens assembly is preferably arranged within the housing between the retainer and the indicator ring. If no sight pin is provided, indicia such as a decal containing a round dot or a small circular ring may be provided on the lens surface.

BRIEF DESCRIPTION OF THE FIGURES

Other objects and advantages of the invention will become apparent from a study of the following specification when viewed in the light of the accompanying drawing, in which:

FIG. 3 is a front perspective view of the housing for the scope of FIG. 1;

FIGS. 4, 5, and 6 are side, front, and rear views, respectively, of the housing of FIG. 3;

FIG. 7 is a sectional view of the housing taken along line 7-7 of FIG. 5;

FIGS. 8 and 9 are front and rear perspective views, respectively, of the sight pin ring assembly of the scope of FIG. 1;

DETAILED DESCRIPTION

Figure 1:
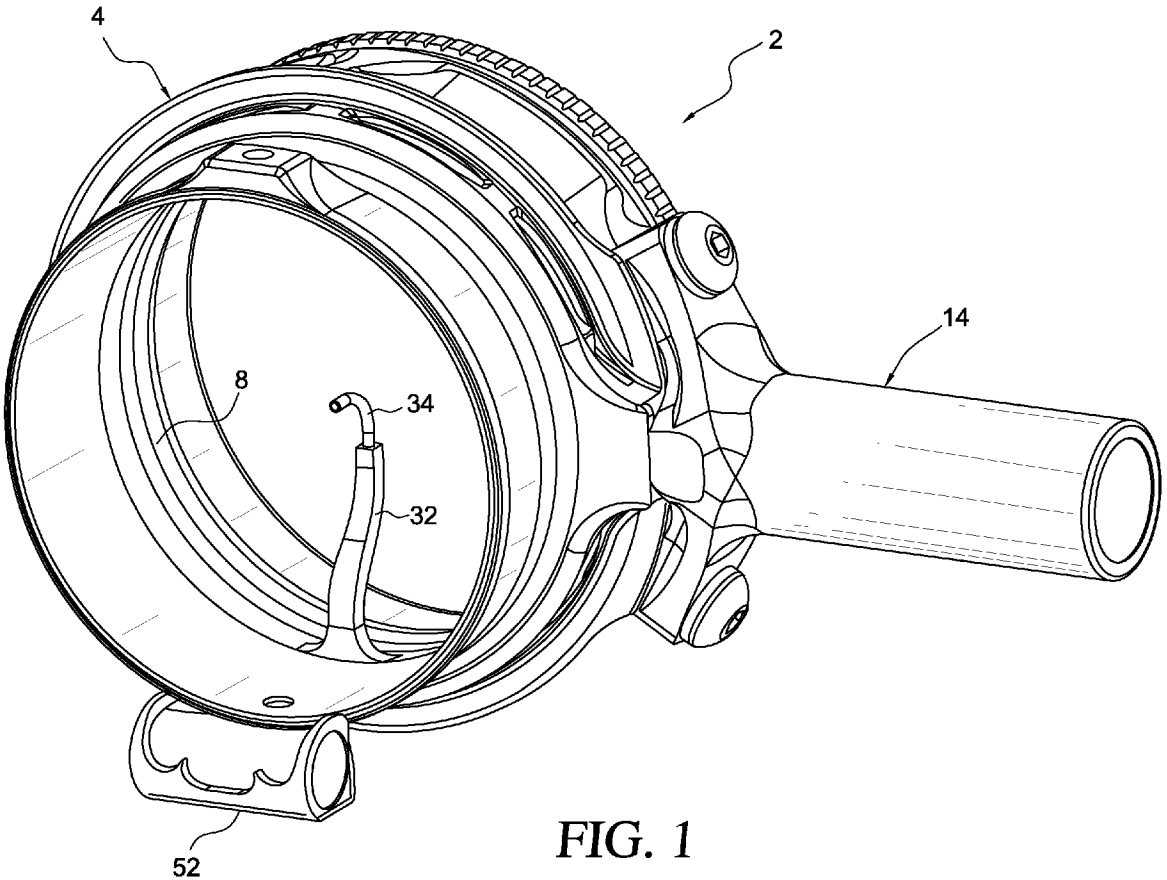
FIG. 1 is a perspective view of the archery scope according to a preferred embodiment of the invention.
Figure 2:
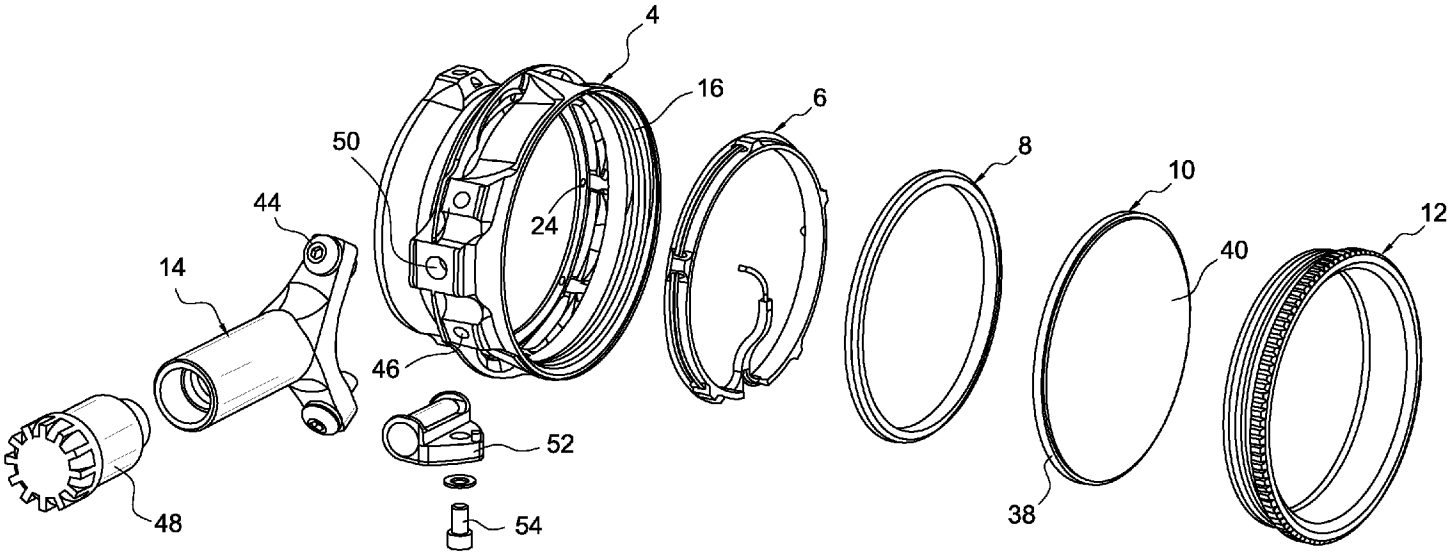
FIG. 2 is an exploded view of the scope of FIG. 1.

The archery scope 2 according to the invention is shown in an assembled condition in FIG. 1 and in an exploded condition in FIG. 2. It includes a housing 4, a ring pin assembly 6, an indicator ring 8, a lens assembly 10 and a retainer 12. A yoke 14 is provided to connect the scope with a sight, not shown.

The housing will be described more particularly in connection with FIGS. 3-7. It has a generally cylindrical configuration extending along a longitudinal axis and is open at both ends. At one end, the housing includes internal threads 16 for removably connecting the retainer 12. A plurality of spaced openings 18 are provided in the housing to allow ambient light to enter the housing adjacent to the ring pin assembly 6 as will be developed in greater detail below. The inner surface of the housing is tapered from the ends toward the middle portion to define a narrow portion 20 intermediate the ends of the housing which produces a Venturi-like effect. The position with the narrowest diameter is sometimes referred to as the waist point of the scope. Within the narrow portion, the housing contains an annular step 22 against which the ring pin assembly is positioned. The step contains a plurality of openings 24 which are arranged in equally spaced relation around the step as shown in FIG. 6. The housing also includes an outer annular flange 26 which is generally coplanar with the step as shown in FIGS. 2 and 7.

The ring pin assembly 6 is shown in more detail in FIGS. 8 and 9. It includes an annular ring 28 having an outer diameter which corresponds generally with the inner diameter of the housing at the narrow portion 20 thereof. The ring 28 contains an opening for receiving a sight pin assembly including a molded, roll-formed, or bent pin body 32 and a tube-like part 34 which terminates in the center of the ring. An optical fiber 36 is wound about the outer surface of the ring, with an end portion of the fiber being threaded through the pin body and terminating at the end of the tube-like part to provide an illuminated point which permits aiming of an archery shot in the same manner as do crosshairs on a sight.

The ring 28 of the ring pin assembly includes at least a pair of pegs 38 which are diametrically opposed on the front surface of the ring. When the ring 28 is positioned within the housing 4 against the housing step 22, the pegs engage a pair of opposed openings 24 in the housing step to anchor the ring in a selected angular position relative to the housing. In this manner, the ring pin body can be oriented in a location within the scope as selected by the archer by positioning the pegs into a selected pair of opposed openings, with the end of the tube-like part being retained in the center of the ring and thus within the center of the scope along the longitudinal axis of the housing. In addition, the ring pin assembly is arranged beneath the openings 18 in the housing 4 so that ambient light may enter the optical fiber 36 to illuminate the sight point. Moreover, the end of the tube-like part is arranged generally coplanar with the housing flange 26 and coplanar with the smallest diameter waist point of the narrow portion 20 as will be developed below.

Referring once again to FIG. 2, the scope further includes at least one annular indicator ring 8. According to a preferred embodiment, the ring 8 has an outer diameter corresponding with the inner diameter of the narrow portion 20 of the housing and an inner diameter corresponding generally with the inner diameter of the ring 28 of the ring pin assembly 6. The indicator ring is preferably colored differently from the remaining components of the scope so that it stands out when the scope is viewed off-axis as will be developed below.

The lens assembly 10 includes an outer lens frame 38 which has an annular configuration with an outer diameter corresponding generally with the inner diameter of the housing narrow portion 20. The lens frame contains an annular recess for receiving a lens 40 in the shape of a circular disk and which is preferably formed of clear glass or plastic material.

The retainer 12 holds the ring assembly, indicator ring and lens assembly in place within the housing. It has an annular configuration and includes external threads which engage the threads 16 on the inner surface of the housing. It is readily apparent that the retainer is removably connected with the housing to allow for removal or replacement of the ring pin assembly 6, the indicator ring 8, and the lens assembly 10. The retainer may be tightened by hand to press against the lens assembly, indicator, and ring pin assembly to hold them in place.

The housing, ring pin assembly ring, lens frame and retainer are formed of any durable rigid lightweight material such as metal or synthetic plastic, and the indicator ring is preferably formed of synthetic plastic material. A preferred metal for the housing is aluminum because of its light weight and durability. The indicator ring has a limited degree of compression and flexure to accommodate compressive forces applied by the retainer when it is tightened with respect to the housing. The housing, ring pin assembly, lens frame and retainer are all preferably formed, plated or painted in the same color with the indicator ring being formed of a different color so that it is visible relative to the remaining components. The housing flange 26 is also preferably engraved or coated with a different color or other type of differentiating material so that it is visibly distinct relative to the housing.

The scope is connected with a sight via the yoke 14. The yoke has a Y-shaped configuration with the upper legs of the yoke being fastened to the housing 4 via screws 44 which are arranged in threaded openings 46 in the outer surface of the housing. With two points of connection between the yoke legs and the housing, a more stable and reliable connection is provided. The yoke is preferably hollow so that a light from an auxiliary light source 48 is transmitted through the yoke and through an opening 50 in the housing aligned with the center of the yoke to transmit auxiliary light to optical fiber encircling the ring pin assembly. The auxiliary light source, such as low energy light emitting diode, is optional and supplements the ambient light delivered to the interior of the housing via the radial openings 18.

A level indicator 52 may also be connected with the housing via a screw 54 to assist the archer in leveling the bow.

Figure 10:
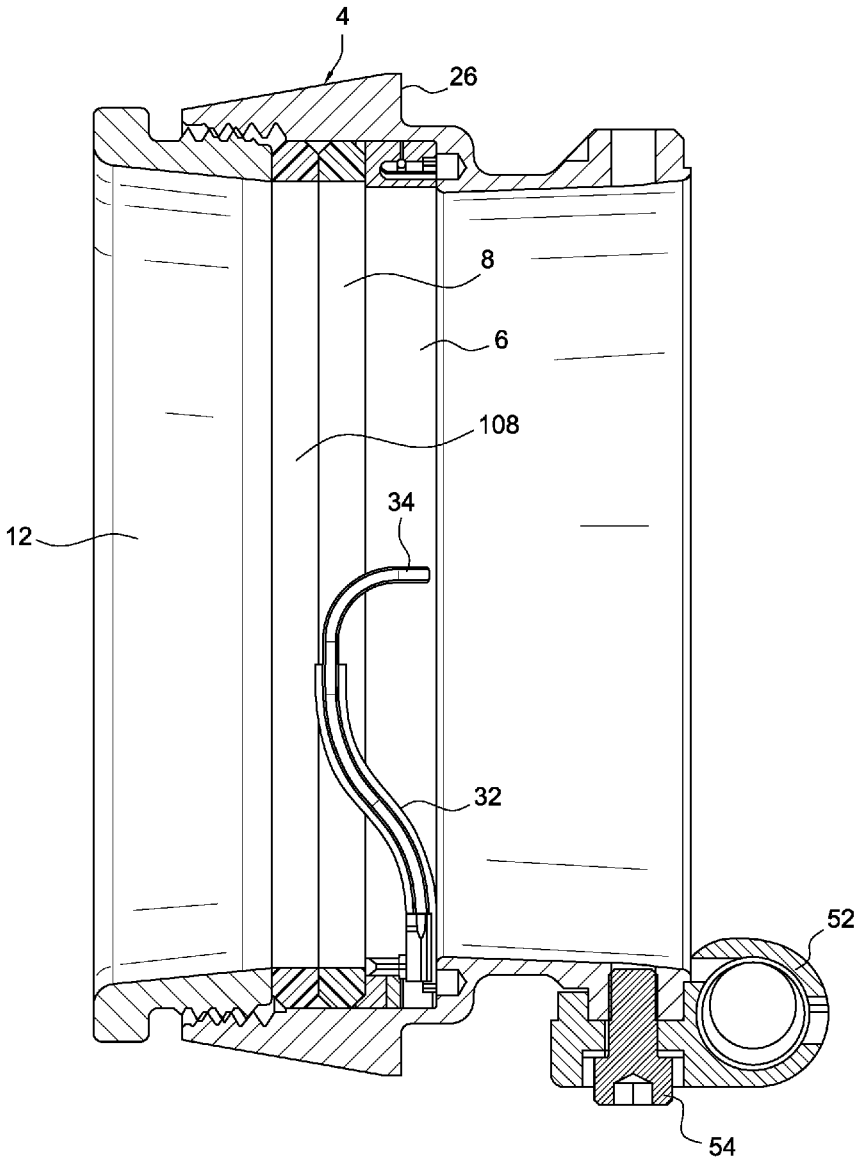
FIG. 10 is a sectional view of the scope according to a preferred embodiment of the invention.
Figure 11:
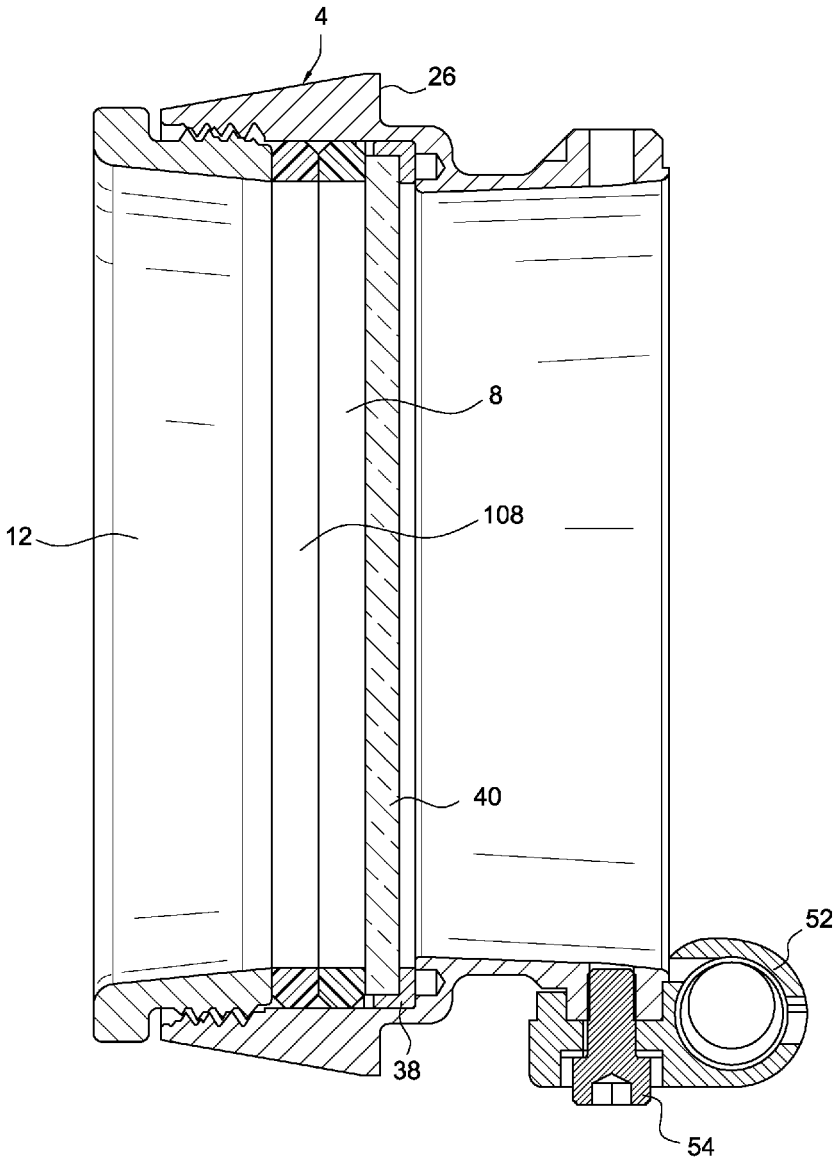
FIG. 11 is a sectional view of the scope according to an alternate embodiment of the invention.

Referring now to FIGS. 10 and 11, different embodiments of the scope will be described. FIG. 10 is a cross-sectional view of a preferred embodiment of the scope corresponding to the assembly shown and described with reference to FIGS. 1-9 except that the lens assembly has been replaced with a second indicator ring 108. As shown therein, the narrow portion 20 of the housing extends in the region containing the ring pin assembly 6, the first and second indicator rings 8, 108 and the lens assembly 10. This portion of the housing has a reduced diameter relative to the open ends of the housing. Thus, the housing inner surface is tapered slightly from the viewing end of the housing, and the inner surface of the retainer 12 is tapered slightly from the rear end of the housing. The smallest diameter portion is the waist point. Technically, the waist point is a location on the narrowest inner circumferential portion of the housing. This portion extends through a plane that also contains the viewing end of the sight pin tube-like part 34.

The narrow portion of the scope produces a Venturi-like effect that allows the sight opening to appear substantially circular when viewed from various directions, even if the user is not viewing the scope straight on. Thus, even if the user is not viewing the sight pin and target straight on through the scope along the longitudinal axis of the housing, the varying diameter still provides a clear circular view to aid in the shot. The Venturi-like effect of the narrowed portion of the housing permits the user to see an undistorted image (i.e., the viewing frame remains substantially circular) at viewing angles θ with respect to central longitudinal axis. The term "Venturi-like effect" as used herein refers to the effect where the viewing frame remains substantially circular at viewing angles θ based on a narrowing in the center of the scope, as compared to the diameters at either end. In standard scopes without the differing diameter as described, any change in viewing angle θ from the longitudinal axis results in the viewing frame becoming distorted. By implementing the differing inner diameters in the housing, a change in viewing angle θ from the axis in the range of one degree up to three degrees, or even up to about seven degrees, does not result in distortion and maintains a round viewing frame to the user. In one implementation, a change in viewing angle θ in a range greater than zero degrees and up to about five degrees does not result in distortion and maintains a round viewing frame to the user. These angular ranges are given only by way of example.

Figure 12:
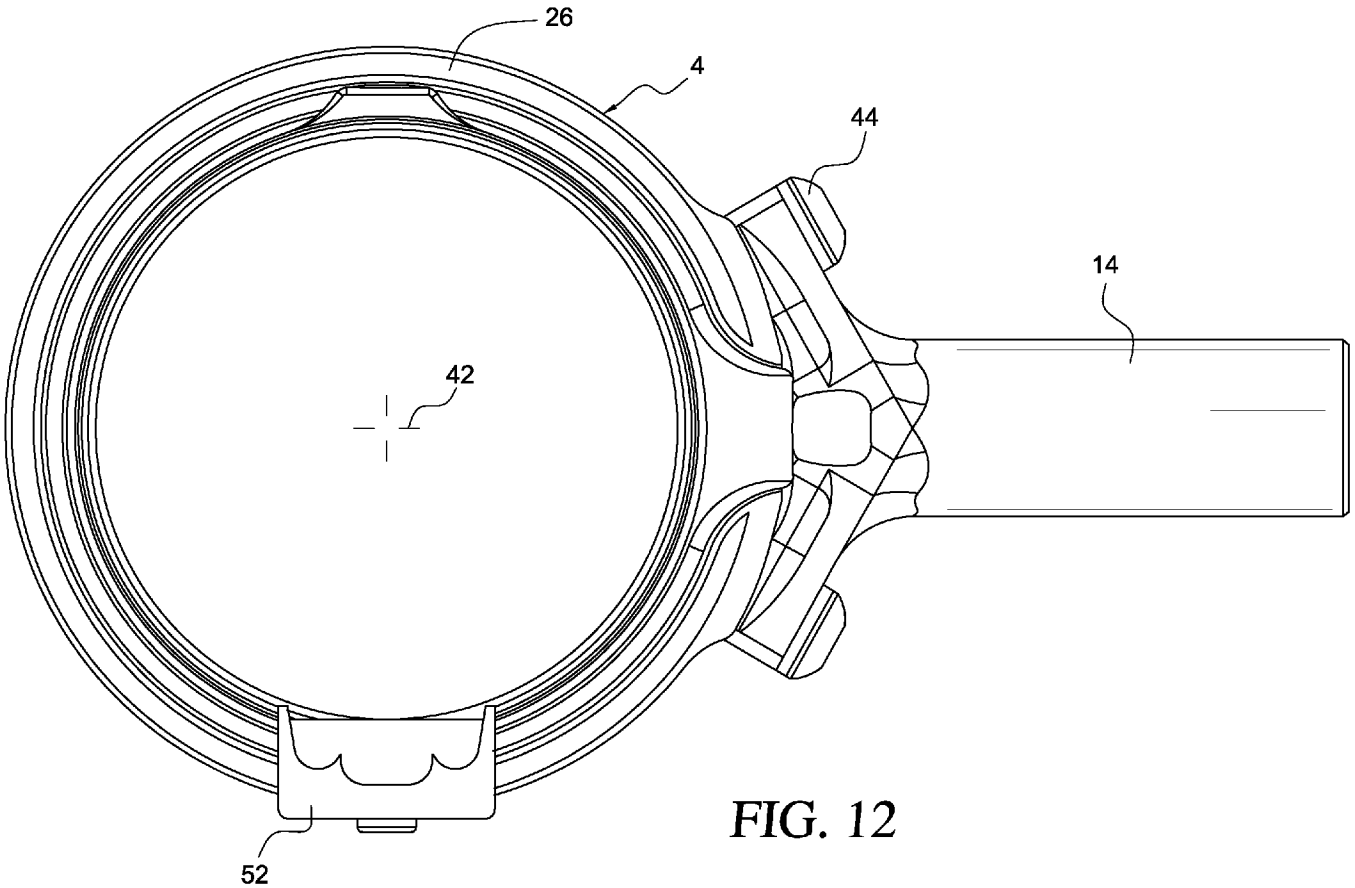
FIG. 12 is a front view of the scope of the embodiment of FIG. 11 when used on a bow under proper torque.

FIG. 11 shows an alternate embodiment of the invention wherein the ring pin assembly is removed and replaced with the lens assembly 10 generally coplanar with the flange 26 and coplanar with the narrowest waist portion of the housing. In order to fill the void of the ring pin assembly, a second indicator ring 108 is provided adjacent to the indicator ring 8. The indicator rings and lens assembly are retained by the retainer 12. The lens bears indicia 42 such as crosshairs, a point, or a circle as shown in FIG. 12 to assist in aligning the bow with a target. The indicia are provided at the center of the lens.

Figure 13:
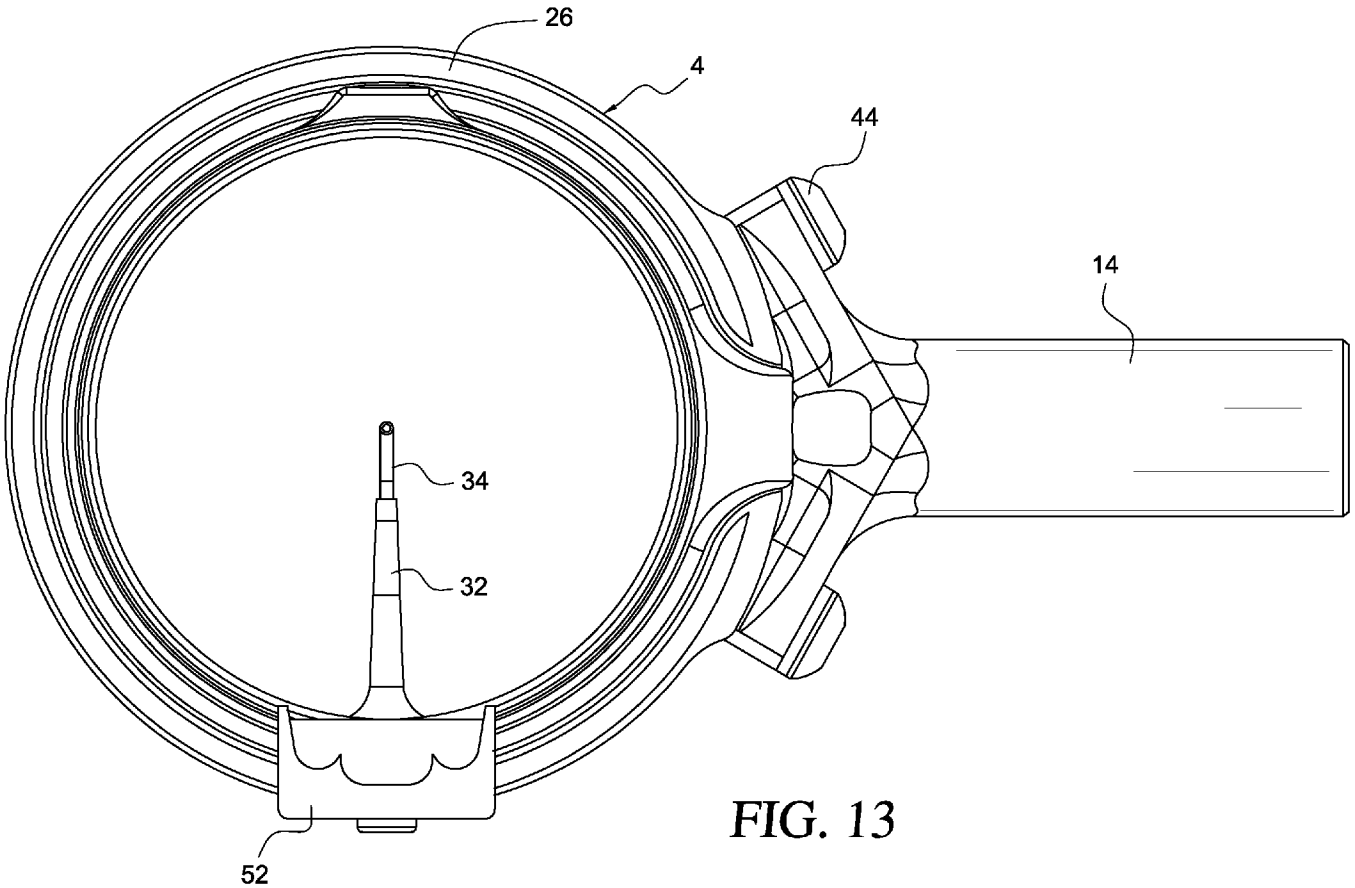
FIG. 13 is a front view of the scope of FIG. 1 when used on a bow under proper torque.
Figure 14:
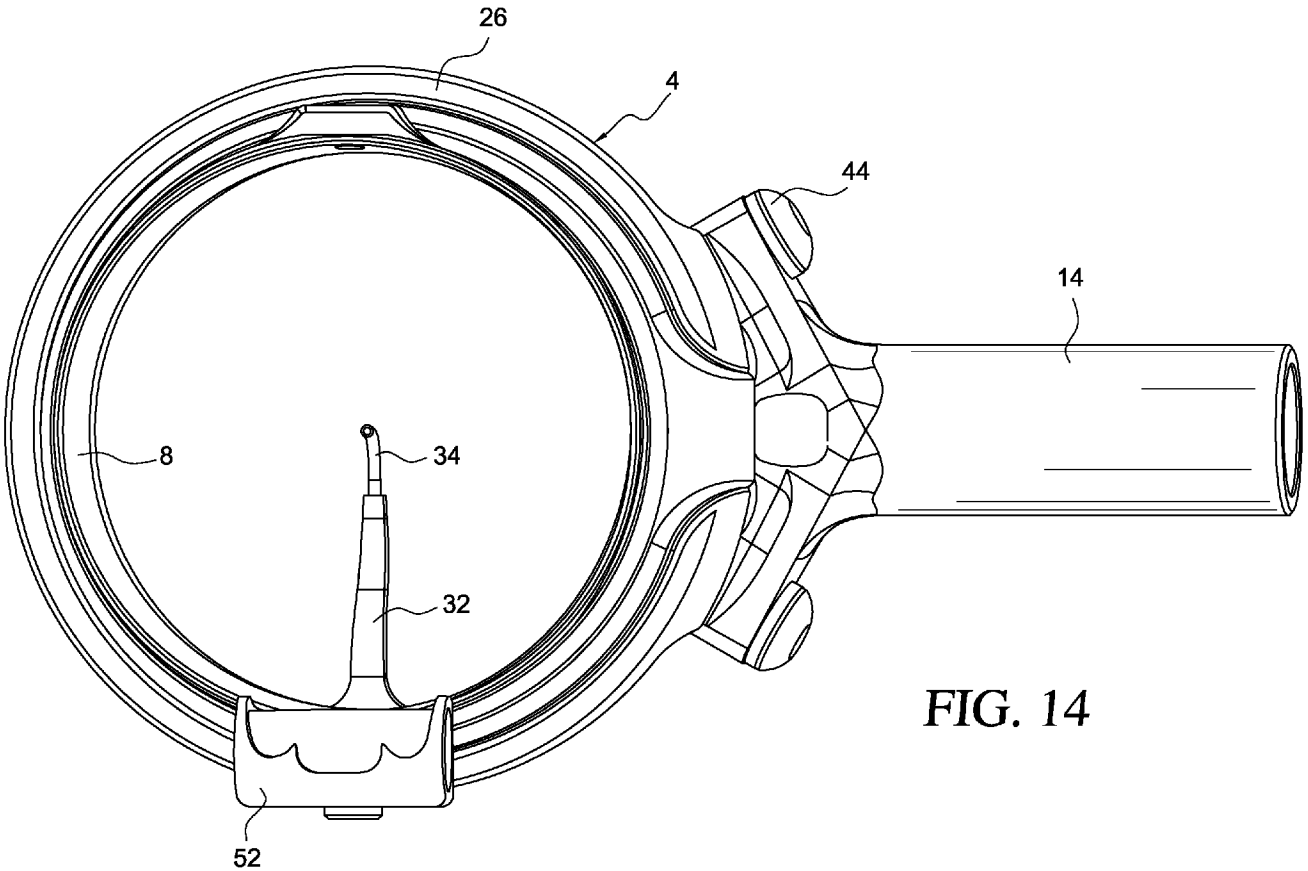
FIG. 14 is a front view of the scope of FIG. 1 showing the indicator ring when used on a bow which has been over-torqued at full draw.

FIG. 13 illustrates the view through the scope of FIG. 1 along the longitudinal axis of the housing. The flange 26 and indicia 42 assist the user with properly aligning the bow for accuracy. FIG. 14 illustrates the view through the scope when the bow has been over-torqued at full draw of the bow. Over-torqueing twists the bow and scope so that the indicator ring 108 is visible to the user. By changing the grip pressure until the indicator ring is no longer visible, the user can return the bow to its proper torque and increase the accuracy of the shot.

While the preferred forms and embodiments of the invention have been illustrated and described, it will become apparent to those of ordinary skill in the art that various changes and modifications may be made without deviating from the inventive concepts set forth above.

What is claimed is:

1. An archery scope, comprising (a) a generally cylindrical housing open at both ends and having a longitudinal axis; and (b) a sight assembly adjustably connected with an inner surface of said housing intermediate the ends thereof, said sight assembly including a ring having a diameter corresponding with an inner diameter of said housing and a sight portion coaxial with said ring and said housing.

2. An archery scope as defined in claim 1, wherein said housing inner surface tapers from the ends thereof toward an intermediate portion of said housing to define a narrow portion which produces a Venturi-like effect where the inner portion of the housing appears substantially circular when viewed from various angles relative to said longitudinal axis.

3. An archery scope as defined in claim 2, wherein said housing narrow portion is arranged in a central region of said housing relative to said longitudinal axis.

4. An archery scope as defined in claim 3, wherein a smallest diameter portion of said housing narrow portion is arranged in said central region.

5. An archery scope as defined in claim 4, wherein said sight assembly is coplanar with said smallest diameter portion of said housing narrow portion.

6. An archery scope as defined in claim 4, wherein said housing inner surface contains an annular seat within said narrow portion, said sight assembly being arranged in contiguous relation with said seat.

7. An archery scope as defined in claim 6, and further comprising an annular retainer removably connected with one end of said housing, said retainer being operable to force said sight assembly against said seat.

8. An archery scope as defined in claim 7, wherein said annular retainer is threadably connected with said housing.

9. An archery scope as defined in claim 6, wherein said housing seat contains a plurality of spaced openings and said ring includes at least one peg adapted to engage a selected opening in said seat, whereby the angular orientation of said sight ring relative to said housing may be adjusted.

10. An archery scope as defined in claim 4, wherein said housing includes an external annular flange generally coplanar with said smallest diameter portion of said narrow portion.

11. An archery scope as defined in claim 10, wherein said flange is generally coplanar with said sight portion.

12. An archery scope as defined in claim 7, and further comprising at least one annular indicator ring arranged within said housing between said ring and said retainer, whereby when said scope is connected with a sight which mounted on a bow and the bow is under excessive torque, said indicator ring is visible to a user.

13. An archery scope as defined in claim 5, wherein said sight assembly includes a sight pin connected with said ring and having an end defining said sight portion.

14. An archery scope as defined in claim 13, wherein said sight pin includes an optical fiber having one end at said sight portion and having a length which is coiled around said ring.

15. An archery scope as defined in claim 14, wherein said housing contains a plurality of through-openings communicating with the interior of said housing narrow portion to allow ambient light to enter said optical fiber.

16. An archery scope as defined in claim 5, wherein said sight assembly includes a lens connected with said ring and having indicia on a surface thereof coaxial with said housing.

17. An archery scope as defined in claim 12, and further comprising a lens assembly arranged within said housing between said retainer and said indicator ring.

18. An archery scope as defined in claim 5, and further comprising means for connecting said scope with a sight.

19. An archery scope as defined in claim 18, wherein said connecting means comprises a yoke connected with said housing.

20. An archery scope as defined in claim 19, wherein said yoke has a Y-shaped configuration, with upper legs of said Y-shaped yoke connected with said housing at two spaced locations.

* * * * *